US006604499B2

(12) United States Patent
Suzuki et al.

(10) Patent No.: US 6,604,499 B2
(45) Date of Patent: Aug. 12, 2003

(54) OIL-THROUGH TYPE PUSH ROD

(75) Inventors: Kazuo Suzuki, Sunto-gun (JP); Iyoshi Watanabe, Numazu (JP); Teruhisa Takahashi, Mishima (JP)

(73) Assignee: Usui Kokusai Sangyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/231,753

(22) Filed: Aug. 29, 2002

(65) Prior Publication Data

US 2003/0041826 A1 Mar. 6, 2003

(30) Foreign Application Priority Data

Aug. 31, 2001 (JP) ..... 2001-262869

(51) Int. Cl.[7] ..... F01L 1/14

(52) U.S. Cl. ..... 123/90.61; 123/90.62; 123/90.63; 74/579 R; 29/888.2; 228/254

(58) Field of Search ..... 123/90.61, 90.62, 123/90.63; 29/888.2, 156.7 B; 74/579 R, 587, 588; 219/96, 107; 228/107, 108, 109, 164, 173.3, 196, 60, 126, 127, 132, 248.1, 254, 256

(56) References Cited

U.S. PATENT DOCUMENTS 2,960,080 A * 11/1960 Burnard et al. ..... 123/90.61
3,101,402 A * 8/1963 Gondek ..... 219/107
3,549,853 A * 12/1970 Guido ..... 219/101
3,908,615 A * 9/1975 Hayward ..... 123/90.61
4,317,267 A * 3/1982 Usui ..... 29/156.7 B
4,436,063 A * 3/1984 Usui ..... 123/90.61
4,991,765 A * 2/1991 Sugiyama ..... 228/164
6,216,557 B1 * 4/2001 Ishiuchi et al. ..... 74/579 R
6,240,972 B1 * 6/2001 Takikawa et al. ..... 138/154

FOREIGN PATENT DOCUMENTS

JP 07284962 A * 10/1995 ..... B23K/11/36
JP 08035407 A * 2/1996 ..... F01L/1/14

* cited by examiner

*Primary Examiner*—Thomas Denion
*Assistant Examiner*—Ching Chang
(74) *Attorney, Agent, or Firm*—Koda & Androlia

(57) ABSTRACT

An oil-through type push rod for, for instance, internal combustion engines including a metal pipe and a metal end fitting which has an oil hole formed therein and is welded to the end of the metal pipe, the metal pipe being provided with a covering layer of a low-melting-point metal for fixing a welding spatter generated during welding, and such a low-melting-point metal covering layer being disposed on at least an inside wall surface of the metal pipe so as to be near an area where the metal end fitting is welded.

6 Claims, 3 Drawing Sheets

OIL-THROUGH TYPE PUSH ROD

BACKGROUND OF THE INVENTION

1. Field of the Invention

The present invention relates to a push rod for operating valves in engines and more particularly to an oil-through type push rod for operating valves in internal combustion engines.

2. Prior Art

Conventionally, an oil-through type push rod has been manufactured by, for instance, an electrical resistance welding method. With this method, a metal end fitting(s) in which the end surfaces are formed into an arc-form of a concave or convex and an oil hole is formed is fastened to the circumferential edge of the opening at one or both ends of a steel pipe.

The conventional push rod of the oil-through type is, as described above, manufactured by welding metal end fitting(s) that has an oil hole(s) to a metal pipe. The most serious problem with such a push rod is that welding spatter that is inevitably generated during the welding is scattered and remains inside the pipe and that in view of the structure of the oil-through type push rod the spatter makes it difficult to clean the inner surface of the push rod.

The drawbacks of the push rods in which welding spatter remains inside thereof will be described below in detail. In other words, the drawbacks of an oil-through type push rod in which welding spatter remains inside the pipes and which is used in an engine assembly will be described below in terms of the manner of use:

1) First, when the engine is started, engine oil is supplied to the interior of the push rod via the oil hole formed in the end fitting, which is located in a position beneath the tappet.
2) The engine oil that is thus supplied passes through the interior of the pipe of the push rod and jets out of the oil hole of the upper end fitting, so that the oil lubricates the rocker arm and intake and exhaust valves that open the intake and exhaust passages, etc.
3) In this lubrication process, since the welding spatter is mixed with the engine oil, oil that contains such welding spatter is transmitted to the various sliding elements.
4) As a result, the welding spatter bites into the respective sliding surfaces of the rocker arm, intake and exhaust valves, etc., so that wear is accelerated, generating wear powder, etc. and shortening the useful life of the engine.

SUMMARY OF THE INVENTION

Accordingly, the present invention eliminates the above-described drawbacks with conventional oil-through type push rods.

It is an object of the present invention to provide an oil-through type push rod with a novel structure that prevents a welding spatter, that is generated and scattered during welding in cases where the oil-through type push rod is manufactured by welding a metal pipe and metal end fittings by, for instance, projection welding, from being left inside the pipe through which the engine oil passes.

The above object is accomplished by a unique structure for an oil-through type push rod which comprises a metal pipe and a metal end fitting that has an oil hole formed therein and is welded to the metal pipe, wherein the metal pipe is provided with a covering layer of a low-melting-point metal, and such a covering layer, which is for fixing a welding spatter generated during welding, is disposed on at least an inside wall surface of the metal pipe so as to be near an area where the metal end fitting is welded.

The above object is accomplished by another unique structure for an oil-through type push rod which comprises a metal pipe and a metal end fitting which has an oil hole formed therein and is welded to the metal pipe, wherein the metal pipe is provided with a covering layer of a low-melting-point metal, and such a covering layer, which is for fixing a welding spatter generated during welding, is disposed on at least an inside wall surface of the metal pipe so as to be near an area where the metal end fitting is welded; and the metal end fitting is provided with a covering layer of a low-melting-point metal, and such a covering layer, which is for fixing a welding spatter generated during welding, is disposed on at least an inside wall surface of the metal end fitting, the inside wall surface being an area where the metal end fitting is welded.

DETAILED DESCRIPTION OF THE INVENTION

The core technical concept of the present invention is that the wear resistance characteristics of sliding elements in, for instance, an internal combustion engine are improved by securely capturing the welding spatter that is inevitably generated and scattered when an oil-through type push rod is made by fastening a metal pipe and a metal end fitting(s) together by welding, and such capturing of the welding spatter is accomplished by a low-melting-point metal layer that is disposed at least on inside wall surface of the metal pipe so that the metal layer is disposed close to the welding position(s) of the metal end fitting(s).

Accordingly, in the present invention, a metal layer of a low-melting-point metal is applied on at least the inside wall surface of the metal pipe so that the low-melting-point metal layer is in the area near where the metal end fitting(s) is welded. Thus, even if the welding spatter (spatter lump) is inevitably generated and scattered when the respective elements (the metal pipe and the metal end fitting(s)) are welded at a high temperature (e.g., a high temperature of around 1500° C.), such a metal spatter comes into contact with the layer of the low-melting-point metal while being cooled, and the low-melting-point metal layer melts and immediately solidifies, thus capturing the metal spatter.

Since the welding spatter that is generated during the welding is assuredly captured, the friction resistance of the sliding elements in engines can be greatly improved.

In the present invention, the metal layer of the low-melting-point metal can be selected from, for instance, tin, indium, copper and alloys of these metals (tin, indium and copper). Plating, for instance, can be employed as a means for forming the metal layer.

Figure 1:
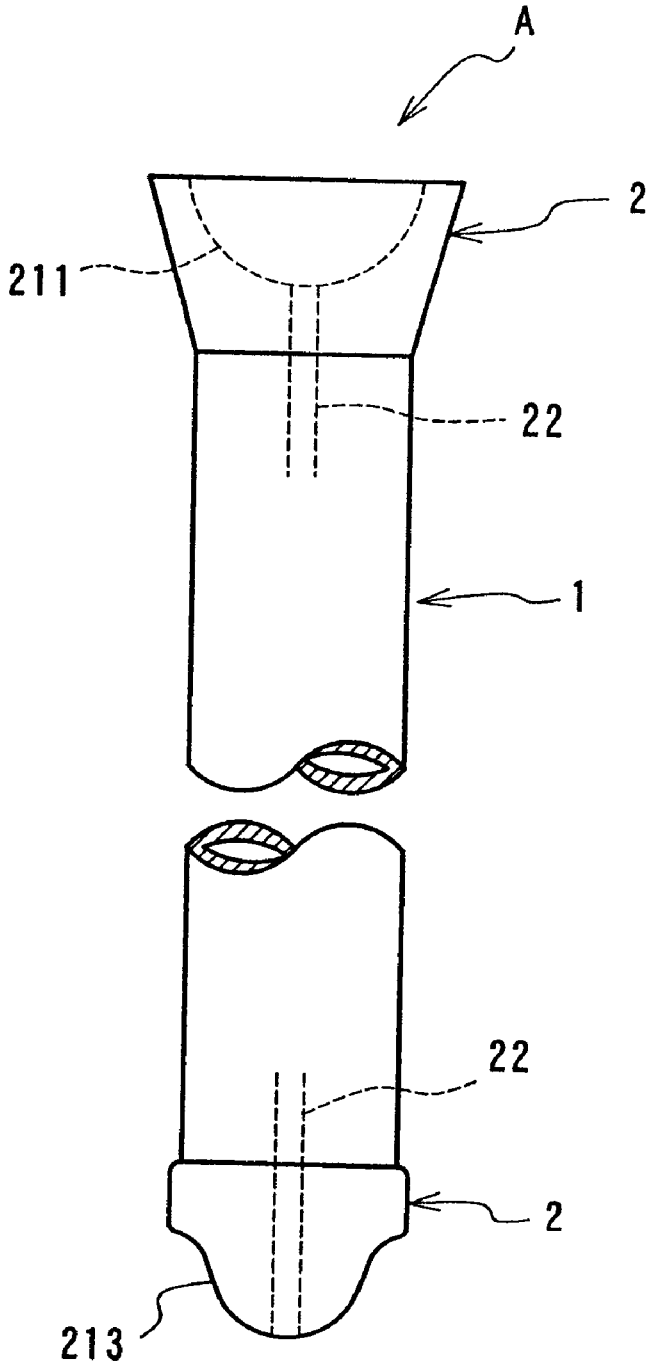
FIG. 1 is an external view of the oil-through type push rod according to the present invention.
Figure 2:
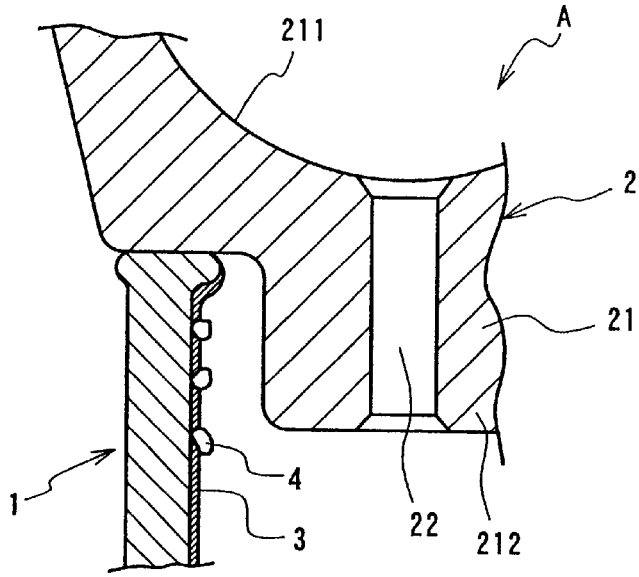
FIG. 2 is a sectional view of the essential portion of the oil-through type push rod of the first embodiment of the present invention.

FIGS. 1 and 2 show the oil-through type push rod A of the first embodiment of the present invention. The oil-through type push rod A is constructed using projection welding, and a metal pipe 1 and a metal end fitting 2 consisting of an end fitting main body 21 in which an oil hole 22 is formed are fastened together.

In the oil-through type push rod A of the shown embodiment, the metal end fitting 2 consisting of the end fitting main body 21 is formed with, as best seen from FIG. 2, a spherical recessed portion 211 and a cylindrical projecting portion 212. The spherical recessed portion 211 is located in the upper part of the main body 21; and the cylindrical projecting portion 212 is located in the lower part of the end fitting main body 21, and it has a size sufficient to be brought into the interior of the metal pipe 1. The oil hole 22 is provided so as to pass through the end fitting main body 21 from the spherical recessed portion 211 to the cylindrical projecting portion 212, so that the oil hole 22 communicates with the internal space of the pipe 1.

In this oil-through type push rod A, the most important characterizing feature is that a plating layer 3 of a low-melting-point metal is disposed on the inside wall surface of the metal pipe 1 as shown in FIG. 2. The plating layer 3 of a low-melting-point metal is disposed on at least the inside wall surface of the metal pipe 1 so that the plating layer 3 is near an area where the metal end fitting 2 is welded.

FIG. 2 shows the high-temperature welding spatter 4 captured by the low-melting-point metal plating layer 3. More specifically, the high-temperature welding spatter 4 that is generated and scattered during the projection welding of the metal pipe 1 and metal end fittings 2 is effectively captured by the low-melting-point metal plating layer 3, which is melted by the high temperature of the welding spatter 4 or the high temperature generated during the welding, and then solidified.

In the present invention, the metal pipe 1 which has the low-melting-point metal plating layer 3 can be manufactured by any desired method.

For example, such a pipe can be manufactured by the methods described below.

(a) Utilizing a pipe material that has been completed as a pipe beforehand, a low-melting-point metal covering layer 3 is applied onto at least the inside wall surface of this pipe material so that the covering layer 3 is disposed in an area that is near the area where the metal end fitting 2 is welded.

(b) Alternatively, a band steel on which a low-melting-point metal is applied in a layer beforehand is used, so that such a band steel is shaped into a cylinder and then formed into a pipe material by electrical joint welding.

Furthermore, in the present invention, the metal end fitting 2 can have a low-melting-point metal plating layer; and such a layer is formed by the method used to form the low-melting-point metal covering layer of the metal pipe 1.

Figure 3:
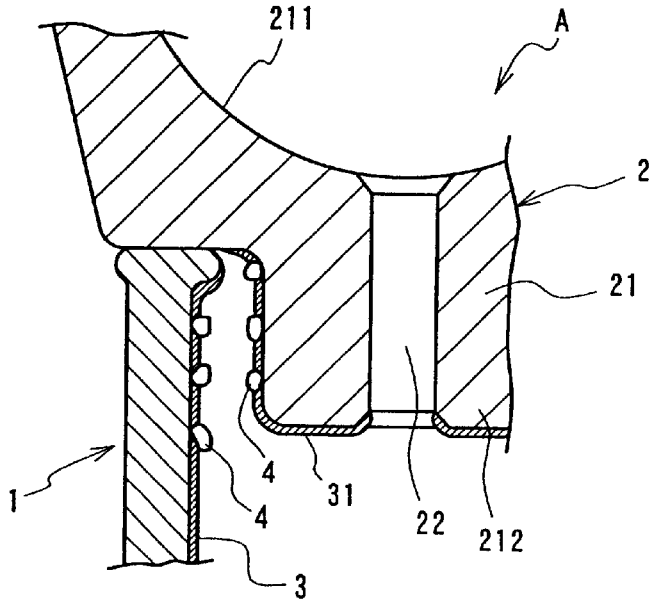
FIG. 3 is a sectional view of the essential portion of the oil-through type push rod of the second embodiment of the present invention.

FIG. 3 shows an oil-through type push rod A of the second embodiment of the present invention. In the oil-through type push rod A of the second embodiment, the low-melting-point metal plating layer 3 is provided on the (inner surface of the) metal pipe 1, and a low-melting-point metal plating layer 31 is also provided on the metal end fitting 2. In other words, on the metal end fitting 2, the low-melting-point metal plating layer 31 is provided at least on the outer surface of the cylindrical projecting portion 212 that is located inside the metal pipe 1, so that the low-melting-point metal plating layer 31 is disposed near where the metal end fitting 2 is welded to the metal pipe 1.

In this structure, the oil-through type push rod A can assuredly capture the welding spatter 4 on the low-melting-point metal plating layer 3 of the metal pipe 1 and on the low-melting-point metal plating layer 31 of the metal end fitting 2 in the same manner as in the first embodiment.

Figure 4:
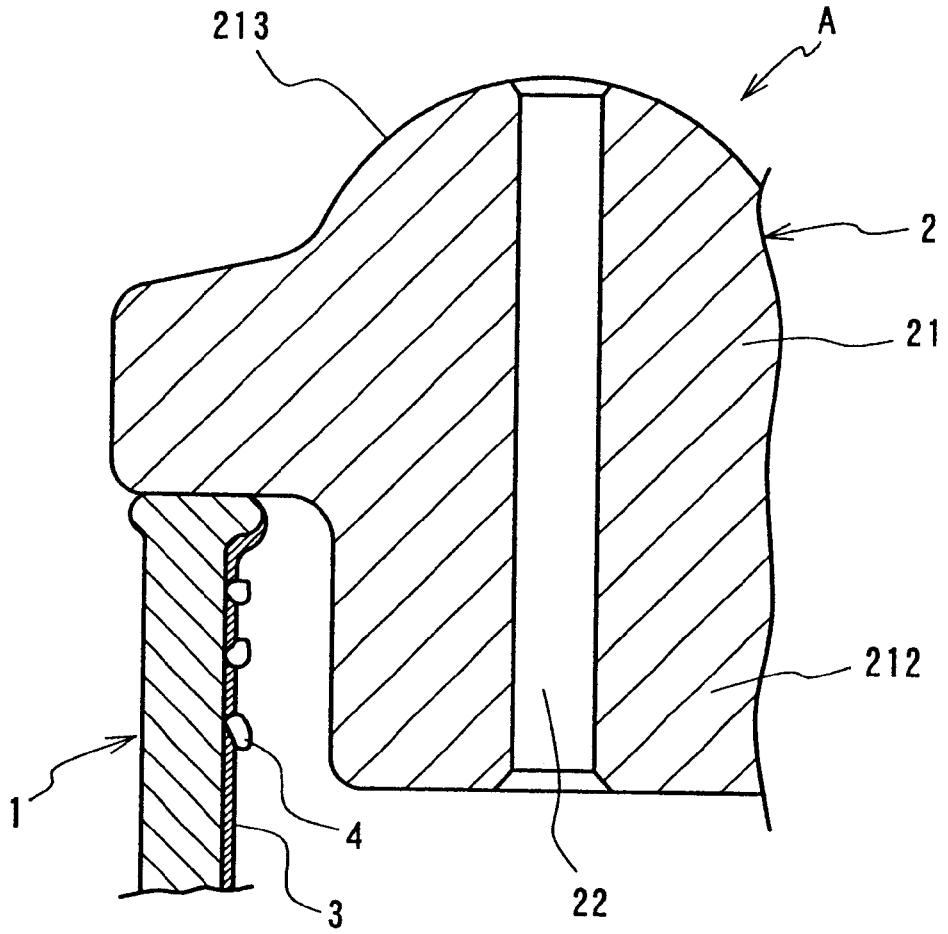
FIG. 4 is a sectional view of the essential portion of the oil-through type push rod of the third embodiment of the present invention.

FIG. 4 shows an oil-through type push rod A of the third embodiment of the present invention.

The oil-through type push rod A of the third embodiment differs from the oil-through type push rod of the first embodiment (FIG. 2) in that the end fitting main body 21 of the metal end fitting 2 has a spherical projecting portion 213. In all other respects, the oil-through type push rod A of the third embodiment is substantially the same as that of the first embodiment.

The oil-through type push rod A of the third embodiment also assuredly captures the welding spatter 4 in the same manner as the first embodiment.

EXAMPLES 1 THROUGH 6 AND COMPARATIVE EXAMPLE (Control) 1

The low-melting-point metal platings were provided on the inner circumferential surfaces of metal pipes, and push rods were manufactured, using projection welding, by way of fastening the metal pipes and metal end fittings having oil holes together. Then, the degree of cleanness after cleaning was measured in each one of the Examples.

In the clearness measurement, 100 ml of a clean measuring solution (dry solvent) was caused to flow into the hollow portions of the push rods manufactured as described above, and the hollow portions were washed out. Foreign matter (welding spatter) was collected using a 3.0 $\mu$m filter. Then, the size of the foreign matter collected in the filter was measured using a microscope.

EXAMPLE 1

Tin electroplating was performed on the inner circumferential surfaces of cut metal pipes, and metal end fittings having oil holes were projection-welded to these metal pipes, thus producing five push rods. No metal fragments exceeding 100 $\mu$m were detected in the cleanness measurements performed on these push rods.

EXAMPLE 2

Tin-zinc electroplating was performed on the inner circumferential surfaces of cut metal pipes, and metal end fittings having oil holes were projection-welded to these metal pipes, thus producing five push rods. No metal fragments exceeding 100 $\mu$m were detected in the cleanness measurements performed on these push rods.

EXAMPLE 3

Indium electroplating was performed on the inner circumferential surfaces of cut metal pipes, and metal end fittings having oil holes were projection-welded to these metal pipes, thus producing five push rods. No metal fragments exceeding 100 $\mu$m were detected in the cleanness measurements performed on these push rods.

EXAMPLE 4

Copper electroplating was performed on the inner circumferential surfaces of cut metal pipes, and metal end fittings having oil holes were projection-welded to these metal pipes, thus producing five push rods. No metal fragments exceeding 100 μm were detected in the cleanness measurements performed on these push rods.

EXAMPLE 5

Tin-copper electroplating was performed on the inner circumferential surfaces of cut metal pipes, and metal end fittings having oil holes were projection-welded to these metal pipes, thus producing five push rods. No metal fragments exceeding 100 μm were detected in the cleanness measurements performed on these push rods.

EXAMPLE 6

A band steel plated with copper was formed into a pipe by a process of pipe-making and electrical joint welding so that the copper-plated surface is located inside of the pipe. The thus obtained pipe material is cut into five pieces, and metal end fittings that have oil holes were fastened by projection welding to these pipes, thus obtaining five push rods. No metal fragments exceeding 100 μm were detected in the cleanness measurements performed on these push rods.

COMPARATIVE EXAMPLE 1

Metal pipes with no plating on the inner circumferential surfaces were fastened by projection welding to metal end fittings that have oil holes, thus producing five push rods. A total of 17 metal fragments exceeding 100 μm, with a maximum size of 854 μm, were detected in the cleanness measurements performed on these push rods.

As seen from the above, the oil-through type valve-operating push rod for an internal combustion engine according to the present invention has superior functions and advantages as described below.

1) In regard to the welding spatter that is generated during the projection welding of the metal pipe and the metal end fitting, since at least the inside wall surface of the metal pipe is covered beforehand with a low-melting-point metal that melts in a relatively low temperature range, the welding spatter that is scattered during the projection welding is assuredly fixed by the molten layer of the low-melting-point metal. Accordingly, the problem of shortening the useful life of engines due to wear caused by the admixture of welding spatter in the engine oil so that this welding spatter bites into sliding elements of the engine is eliminated.

2) In the present invention, by way of forming the covering layer of a low-melting-point metal beforehand on, in addition to the metal pipe, the metal end fitting that faces the area of the welding made for fastening the metal pipe and the end fitting together, an even more superior effect can be obtained in the fixing (or capturing) of welding spatter.

3) The present invention is applicable to a push rod made of a metal pipe that is formed by a band steel. Such a band steel covered beforehand with a low-melting-point metal is used as the starting material, and it is shaped into a cylinder and formed into pipe by electrical joint welding. The metal pipe made of a band steel is superior in terms of productivity and economy to a pipe structure in which the low-melting-point metal layer is applied on its inside wall surface.

The present invention is not limited to the embodiments described above. It goes without saying that various modifications, design alterations, etc. that involve no departure from the technical concept of the present invention are included in the scope of the present invention.

What is claimed is:

1. An oil-through type push rod comprising a metal pipe and a metal end fitting which has an oil hole formed therein and is welded to said metal pipe, wherein said metal pipe is provided with a covering layer of a low-melting-point metal, and said covering layer, which is for fixing a welding spatter generated during welding, is disposed on at least an inside wall surface of said metal pipe so as to be near an area where said metal end fitting is welded.

2. An oil-through type push rod comprising a metal pipe and a metal end fitting which has an oil hole formed therein and is welded to said metal pipe, wherein said metal pipe is provided with a covering layer of a low-melting-point metal, and said covering layer, which is for fixing a welding spatter generated during welding, is disposed on at least an inside wall surface of said metal pipe so as to be near an area where said metal end fitting is welded; and said metal end fitting is provided with a covering layer of a low-melting-point metal, and said covering layer, which is for fixing a welding spatter generated during welding, is disposed on at least outer surface of a part of said metal end fitting, said part being inside said metal pipe and near an area where said metal end fitting is welded.

3. The oil-through type push rod according to claim 1 or 2, wherein said low-melting-point metal is one selected from the group consisting of tin, indium, copper and alloys thereof.

4. The oil-through type push rod according to claim 1 or 2, wherein said metal pipe is made of a pipe material and has said covering layer of said low-melting-point metal used for fixing welding spatter that is generated during welding on at least an inside wall surface of said pipe material in an area that is near a welding site.

5. The oil-through type push rod according to claim 1 or 2, wherein said metal pipe is obtained by shaping a band steel, which has been covered beforehand with a low-melting-point metal, into a cylinder and then forming into said metal pipe by electrical joint welding.

6. The oil-through type push rod according to claim 2, said metal end fitting is covered beforehand by a low-melting-point metal on at least an inside wall surface of said metal end fitting, said inside wall surface being an area where said metal end fitting is welded.

* * * * *